US008403011B1

(12) United States Patent
McKendry

(10) Patent No.: US 8,403,011 B1
(45) Date of Patent: Mar. 26, 2013

(54) INTERCHANGEABLE FLAP HANDBAG

(76) Inventor: Dorothy R. McKendry, Las Vegas, NV (US)

( * ) Notice: Subject to any disclaimer, the term of this patent is extended or adjusted under 35 U.S.C. 154(b) by 936 days.

(21) Appl. No.: 11/759,171

(22) Filed: Jun. 6, 2007

(51) Int. Cl.
*A45C 13/08* (2006.01)

(52) U.S. Cl. ..... 150/104; 150/100; 150/103; 190/110; 190/119; 206/233

(58) Field of Classification Search ..... 150/104, 150/105, 118, 103; 190/110, 119; 206/233
See application file for complete search history.

(56) References Cited

U.S. PATENT DOCUMENTS

| | | | | | |
|---|---|---|---|---|---|
| 179,749 | A | * | 7/1876 | Weiss | 292/341 |
| 1,152,346 | A | | 8/1915 | Spiro | |
| 1,747,801 | A | * | 2/1930 | Topal | 150/104 |
| 1,867,116 | A | | 7/1932 | Thornhill et al. | |
| 1,972,576 | A | | 9/1934 | Walinsky | |
| 1,990,360 | A | * | 2/1935 | Anish | 150/105 |
| 2,080,453 | A | * | 5/1937 | Kraut | 150/104 |
| 2,093,097 | A | | 9/1937 | Potash | |
| 2,289,304 | A | | 7/1942 | Goldsmith | |
| 2,721,596 | A | | 10/1955 | Danneil | |
| 2,723,696 | A | * | 11/1955 | Kase | 150/105 |
| 2,784,756 | A | * | 3/1957 | Resnick | 150/103 |
| 2,798,524 | A | | 7/1957 | Ryon | |
| 3,347,299 | A | * | 10/1967 | Alexander | 150/113 |
| 4,027,710 | A | | 6/1977 | Keebler | |
| 4,250,938 | A | | 2/1981 | Siegel | |
| 4,685,546 | A | | 8/1987 | Sadow | |
| 4,739,809 | A | * | 4/1988 | Adams | 150/112 |
| 5,009,319 | A | * | 4/1991 | Jantzen | 206/544 |
| D318,370 | S | | 7/1991 | White | |
| 5,503,204 | A | * | 4/1996 | Byers et al. | 150/105 |
| D370,341 | S | * | 6/1996 | Azar et al. | D3/233 |
| 5,725,039 | A | * | 3/1998 | Macinai et al. | 150/104 |
| 5,947,241 | A | | 9/1999 | Rausch | |
| 6,070,628 | A | * | 6/2000 | Nastasi | 150/118 |
| 6,668,882 | B1 | | 12/2003 | Cazes | |
| 7,055,564 | B2 | | 6/2006 | Carey et al. | |
| 2002/0029831 | A1 | | 3/2002 | Pendergrass | |
| 2006/0037682 | A1 | * | 2/2006 | Reiter | 150/107 |
| 2007/0177766 | A1 | * | 8/2007 | Kasahara et al. | 382/115 |
| 2007/0199966 | A1 | * | 8/2007 | Korchmar | 224/578 |

(Continued)

FOREIGN PATENT DOCUMENTS

| | | |
|---|---|---|
| FR | 2629794 | 10/1989 |
| GB | 223823 | 10/1924 |

(Continued)

OTHER PUBLICATIONS

"Tachima Bags," http://www.baghome.com.tw/ArticleShow.asp?ArticleID=117, Mar. 27, 2007.

(Continued)

*Primary Examiner* — Anthony Stashick
*Assistant Examiner* — Cynthia Collado
(74) *Attorney, Agent, or Firm* — Blakely Sokoloff Taylor & Zafman LLP

(57) ABSTRACT

An interchangeable handbag system. The system includes a handbag body having an open top and an interchangeable flap. The interchangeable flap may be removeably attached to the handbag body to cover an opening of the handbag body. In other embodiments, the interchangeable flap may be removeably attached to itself to form a separate handbag.

6 Claims, 10 Drawing Sheets

U.S. PATENT DOCUMENTS

| | | | | |
|---|---|---|---|---|
| 2007/0221136 | A1 * | 9/2007 | Buttner | 119/497 |
| 2008/0230158 | A1 | 9/2008 | Romero et al. | |

FOREIGN PATENT DOCUMENTS

| | | |
|---|---|---|
| GB | 307269 | 3/1929 |
| TW | 292946 Y | 7/2006 |

OTHER PUBLICATIONS

"Changeable Leather Bag," http://www.betterware.co.uk/productdetails.aspx?pid=018622&cid=234&language=en-GB, Mar. 27, 2007.

* cited by examiner

INTERCHANGEABLE FLAP HANDBAG

BACKGROUND

1. Field

An interchangeable handbag system. More specifically, a handbag having a body and an interchangeable flap modifiable to form a handbag separate and independent from the body.

2. Background

Whether it is to enhance the appearance of a person's wardrobe or to securely carry personal effects, bags, and in particular, handbags, of varying shapes and sizes are considered by many people to be an essential component of their wardrobe. There have been a variety of improvements made to the aesthetic as well as functional aspects of handbags over the years. One such improvement includes making different components of the handbag removable and/or interchangeable. For example, handbag flaps, straps and panels may be removed and replaced with another flap, strap or panel.

Often times, however, these interchangeable handbag designs lack the sleek appearance of their non-interchangeable counterparts. In particular, in the interchangeable flap handbag designs, the releasable securing mechanism which replaces the seam typically used to attach the flap to the handbag is often visible and adds significant bulk at the attachment point. In addition, it is often difficult and time consuming to align the components used to attach or remove the flap from the handbag. Accordingly, the interchangeable features are inconvenient to use and undesirably alter the appearance of the handbag.

BRIEF DESCRIPTION OF THE DRAWINGS

Embodiments are illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1:
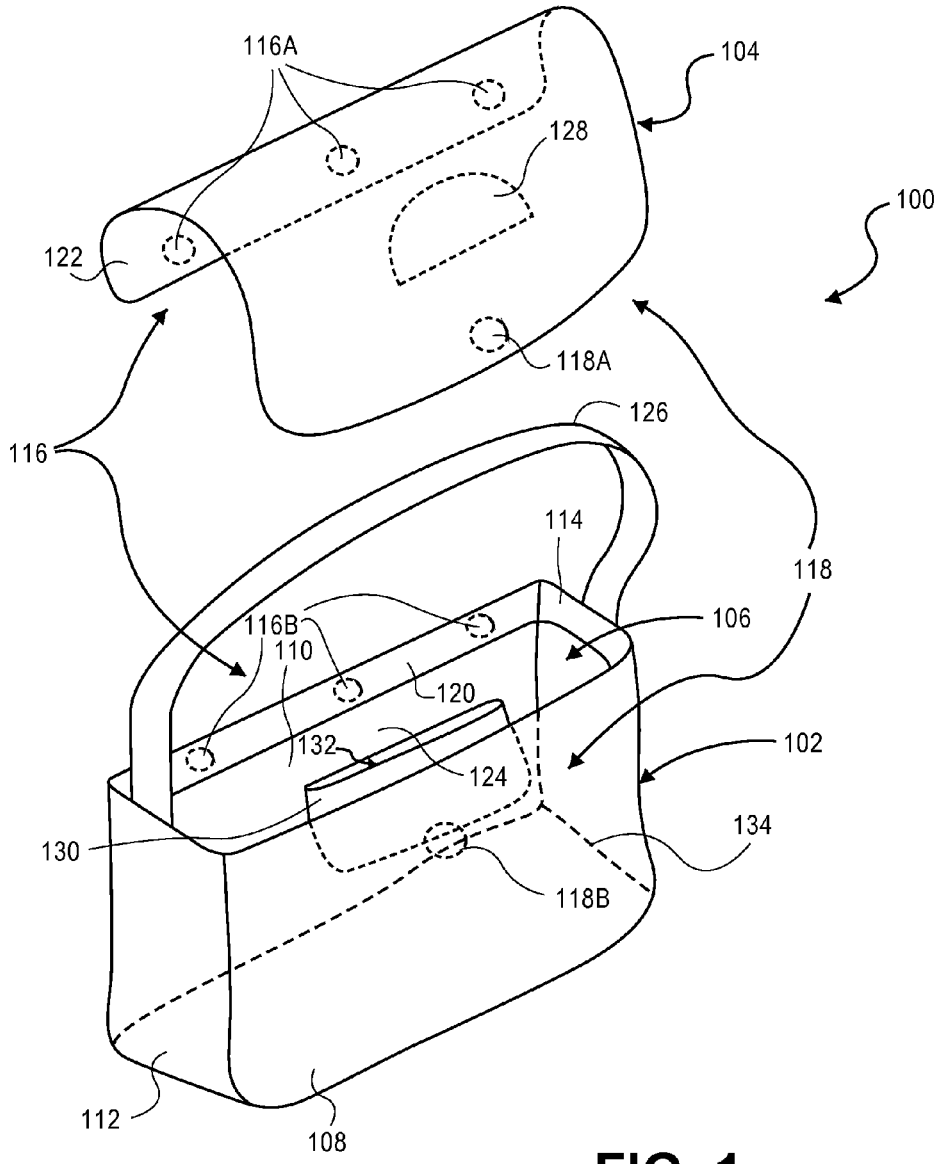
FIG. 1 shows a perspective view of a handbag system with a flap separate from a handbag body.

FIG. 1 shows a perspective view of a handbag system. In one embodiment, system 100 includes a body 102 having an open top 106 and a flap 104. As illustrated in FIG. 1, flap 104 is removed from body 102. In this aspect, it is contemplated that body 102 may be used with flap 104 or without flap 104 (i.e., carried as a purse without a flap). Body 102 includes front panel 108, back panel 110, side panels 112, 114 and base 134. Panel 108, back panel 110, side panels 112, 114 and base 134 define a volume within body 102 for holding or storing items of the user. Panel 108, back panel 110, side panels 112, 114 and base 134 may be separate sections attached together by, for example, sewing their edges together. Alternatively, panels 110, 112, and 114 and base 134 may be formed from a single piece of material.

Although in this embodiment, body 102 is shown having rectangular dimensions, it is further contemplated that body 102 may have any size or shape including a square, semicircular or trapezoidal shape. For example, in some embodiments, body 102 may have the size and dimensions of a handbag body including, but not limited to, a purse body, diaper bag body, travel bag body, brief case body or the like, suitable for carrying small items, diapers, travel items, documents including legal documents and files and the like.

It is further contemplated that body 102 may include pocket 130 or other features to further compartmentalize the volume therein. In some embodiments, pocket 130 of body 102 may have opening 132 within the volume defined by front panel 108, back panel 110, side panels 112, 114 and base 134. Alternatively, opening 132 may be along an outer surface of body 102. Opening 132 may include a sealing mechanism, such as, a zipper, snap, button or the like, to close the pocket opening and prevent items stored within pocket 130 from falling out.

In addition to body 102 and flap 104, system 100 includes strap 126 that, in this embodiment, is attached at opposite ends to portions of body 102. Strap 126 facilitates carrying of body 102 and any contents stored within body 102. Representatively, each of the opposite ends of strap 126 may be sewn to one of side panels 112 and 114. Alternatively, strap 126 may be attached at opposite ends to back panel 110 and a second strap may be attached to front panel 108 to provide a dual strap configuration. It is contemplated that strap 126 may have any dimensions and be attached to body 102 in any manner suitable for supporting body 102 and the weight of the contents that may be stored within body 102. In addition, in some embodiments, strap 126 may be adjustable to increase or decrease a length of strap 126. It is further contemplated that any other suitable device to facilitate carrying of body 102 and its contents therein may be used, including, but not limited to, handles.

Flap 104 may be attached to body 102 between ends of strap 126 and along a top portion of back panel 110. Once attached, flap 104 may be folded over open top 106 to cover open top 106 and conceal items within body 102.

In an alternative embodiment, flap 104 may be attached to itself to form a handbag separate from body 102 as will be described in more detail in reference to FIG. 5. In this aspect, flap 104 may have a handle or its own strap separate from body 102 to facilitate carrying of flap 104 when attached to body 102 or used alone as its own handbag.

Flap 104 may have any dimension and shape suitable for covering a body opening as well as forming a separate handbag. For example, flap 104 may have a semicircular shape as shown in FIG. 1 or a square, rectangular, triangular or trapezoidal shape.

In some embodiments, flap 104 may include pocket 128. Pocket 128 may have an opening along an inner surface of flap 104 for accessing a compartment formed by pocket 128. The compartment of pocket 128 may be formed between an outer and inner surface of flap 104. Alternatively, a material defining pocket 128 may be exposed along an outer surface of flap 104. The opening may include a sealing mechanism, such as, a zipper, snap, button or the like, to close the opening and prevent items stored within pocket 128 from falling out. Although pocket 128 is shown having an opening along an inner surface of flap 104, it is further contemplated that the opening may be formed along an outer surface of flap 104. In this aspect, the pocket opening may be exposed to an outer surface of handbag assembly 100 when flap 104 is used to cover opening 106 of body 102 or folded over itself to form a clutch type handbag.

Body 102, flap 104 and strap 126 may be of the same or different material. Suitable materials for body 102, flap 104 and strap 126 may include, but are not limited to, leather, woven, plastic or fur materials. The material selected for flap 104 may have the same or a different design, texture or color than that of body 102 to further enhance the appearance of handbag system 100. For example, in some embodiments, flap 104 may be of the same material as body 102 and have a woven pattern down its center or be of a different color.

In some embodiments, a number of interchangeable flaps 104 may be provided to enhance or change the appearance of body 102. Thus, system 100 may include a number of flaps 104. In this aspect, the plurality of flaps 104 may be made of the same or different materials and have different designs, textures, colors, and possibly shapes. For example, in some embodiments, body 102 may be made of a black leather material and a first flap may be attached to body 102 which is of the same material and color and has a woven pattern down its center as described above. A second flap may be provided that is made of a different colored material. A user may change the appearance of body 102 by replacing the first flap with the second flap having a different color. In this aspect, system 100 allows the user to change the appearance of their handbag without actually changing bags. Alternatively, the user can remove flap 104 from body 102 altogether. Body 102 may then be used without a flap. Still further, flap 104 may be used by itself where a smaller handbag is desired. In this aspect, at least three or more different handbag configurations may be achieved by handbag system 100.

Still further, some of the flaps 104 may be a different color or material or have a different texture on each side to provide a reversible flap. For example, the flap may have a leather inner surface and an outer surface formed by a fur material. The flap may then initially be folded upon itself with the leather side exposed but then reversed to expose the fur side. In this aspect, handbag system 100 may be converted from a single handbag having body 102 and flap 104 to at least three additional different handbags (i.e., body 102 without flap 104, flap 104 folded upon itself with a fur side exposed and flap 104 folded upon itself with a leather side exposed).

Although two flaps are described, it is contemplated that any number of interchangeable flaps 104 having a variety of sizes, shapes and appearances may be provided.

Figure 2:
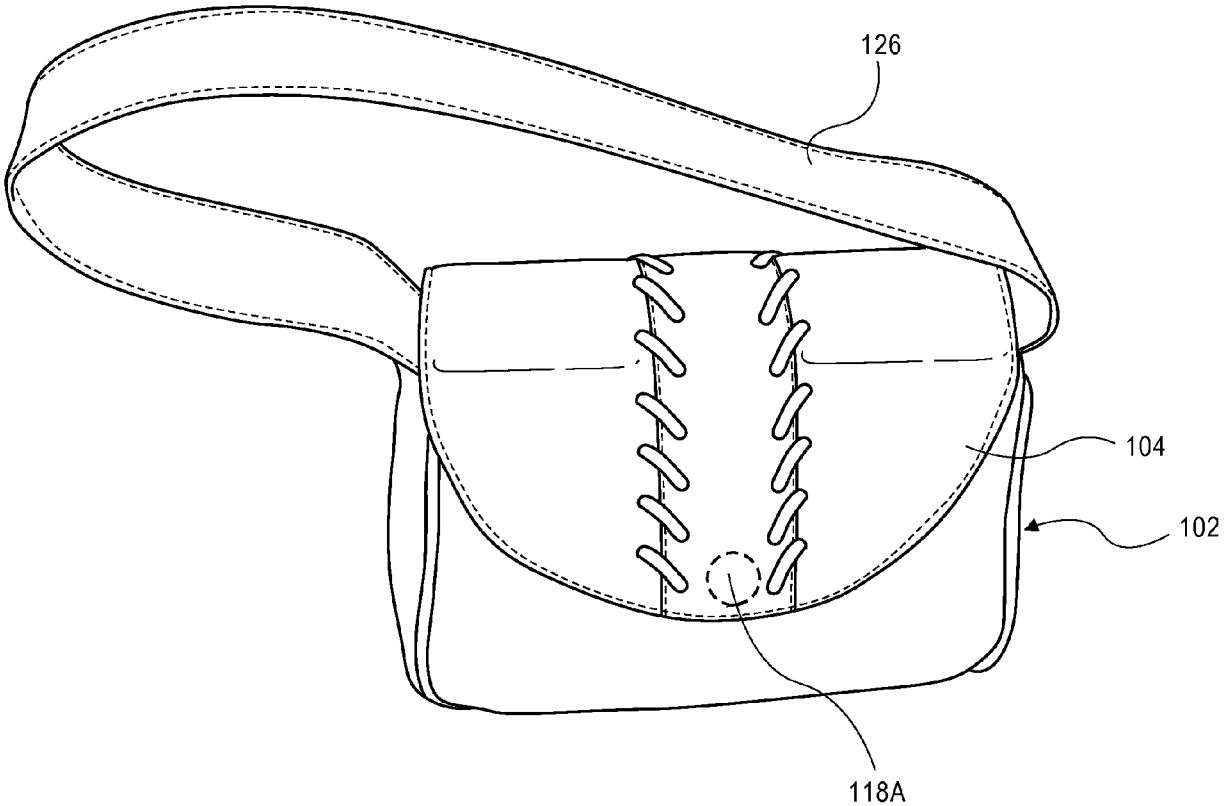
FIG. 2 shows a perspective view of the handbag system of FIG. 1 with the flap attached to the handbag body.

Flap 104 may be removeably attached to body 102 or itself with an attachment mechanism 116 or 118. FIG. 2 illustrates an embodiment where flap 104 is attached to body 102. In this aspect, a back portion of flap 104 is attached to back panel 110 of body 102 via attachment mechanism 116. In addition, a front portion of flap 104 is attached to front panel 108 of body 102 to hold flap 104 over opening 106 in a closed position via attachment mechanism 118.

Each of attachment mechanisms 116 and 118 include complimentary attachment components 116A, 116B and 118A, 118B, respectively. Attachment components 116A, 116B and 118A, 118B may be completely concealed within flap 104 or a panel of body 102. In this aspect, attachment mechanisms 116 and 118 are hidden from view regardless of whether flap 104 is connected to body 102. In addition, attachment mechanisms 116 and 118 are dimensioned such that they do not add bulk to or otherwise take away from the appearance of handbag system 100.

In some embodiments, attachment mechanism 116 may be concealed within body 102 or flap 104 by positioning attachment mechanism 116 between layers of material forming body 102 and flap 104. For example, in some embodiments, body 102 may include a reinforcement strip 120 around opening 106 and a lining 124 to protect body 102. Flap 104 may further include a lining 122. Lining 122, 124 and reinforcement strip 120 may be of the same or different material as body 102 and flap 104.

Attachment components 116A may be embedded between lining 122 and the outer surface of flap 104. Attachment components 116B may be embedded between reinforcement strip 120 and an outer panel of body 102. This may be accomplished by, for example, securing attachment components 116B to a surface of reinforcement strip 120 prior to sewing reinforcement strip 120 and lining 124 to back panel 110. Attachment components 116B may be secured to reinforcement strip 120 by, for example, an adhesive. It is further contemplated, that any other technique capable of securing attachment components 116B to body 102 and attachment components 116A to flap 104 without exposing a portion of the attachment components outside of handbag system 100 may be used. Although attachment mechanism 116 is described in detail, it is further contemplated that attachment mechanism 118 and its associated components 118A, 118B, may be secured to flap 104 and body 102, respectively, in a similar manner to that described in reference to attachment mechanism 116.

In some embodiments, attachment mechanism 118 may be used to removeably secure flap 104 to front panel 108 of body 102. In this aspect, flap 104 provides a cover over opening 106 of body 102. Flap 104 is then held in a closed position by folding flap 104 over opening 106 and attaching flap 104 to front panel 108 via attachment mechanism 118. Flap 104 may in turn be opened by releasing attachment mechanism 118 and unfolding flap 104.

Attachment mechanism 118 may be substantially the same as attachment mechanism 116. In this aspect, attachment mechanism 118 may include attachment component 118A positioned along a front portion of flap 104 and complimentary attachment component 1188 may be positioned along front panel 108 of body 102. Attachment component 118A may be embedded between lining 122 and an outer panel of flap 104. Attachment component 118B may be embedded between reinforcement strip 120 or lining 124 and front panel 108 of body 102. Attachment components 118A, 118B may be positioned so that when flap 104 is secured to back panel 110 of body 102 and folded over openings 106, attachment components 118A, 118B are aligned.

In some embodiments, a suitable attachment mechanism 116 may be a pair or set of magnets having oppositely facing poles that attract the magnets to each other. For example, in one embodiment, attachment components 116A may be disc shaped magnets having a south pole facing an inner surface of flap 104. Attachment components 116B may be magnets having north poles facing an outer surface of back panel 110. Attachment components 116B are then positioned linearly along an upper edge of back panel 110. Attachment components 116A are linearly positioned along a back portion edge of flap 104. In this aspect, attachment components 116A may be aligned with attachment components 1168 when the back portion of flap 104 is positioned along the edge of back panel 110 of body 102.

The attractive forces between the magnets draw the magnets, and in turn, flap 104 and body 102, toward each other. Thus, the user need only place the attachment mechanisms of the flap 104 and body 102 within about two inches of each other and the magnets will automatically align and attach themselves to one another. In this aspect, flap 104 may be quickly and easily secured to body 102 with minimal user effort and time. Similarly, to remove flap 104 from body 102, the user need only pull flap 104 in a direction away from body 102 to remove flap 104 from body 102. The magnets used for attachment components 116A, 116B are strong enough however, to prevent unintentional release of flap 104 from body 102.

In some embodiments, different poles of attachment components 116A and 116B may face inner and outer surfaces of flap 104 and body 102, respectively, so long as they align with an opposite pole when flap 104 is positioned adjacent body 102. For example, a north pole of a center attachment component 116A and a south pole of outer attachment components 116A may face the inner surface of flap 104 while a north pole of center attachment component 1168 and a south pole of outer attachment components 116B may face an outer surface of body 102. Although three of each of attachment components 116A and 116B are illustrated, it is contemplated that any number of attachment components 116A, 116B suitable for removeably securing flap 104 to body 102 may be used.

Still further, it is contemplated that one of attachment components 116A and 1168 may be a magnet while the other may be a metal which is attracted to the magnet. Although a disc shaped magnet is described, it is to be recognized that the shape and dimensions of the magnet used for attachment mechanisms 116 may vary depending upon how they are being used and the size and shape of system 100. Accordingly, magnets of varying sizes and shapes are contemplated, including, but not limited to, square, rectangular, triangular, trapezoidal and oval shaped magnets.

The type of magnet used for attachment mechanisms 116 and 118 may vary depending upon the strength of attachment desired. For example, it may be desired that attachment mechanism 116 which attaches flap 104 to back panel 110 of body 102 provide a highly secure attachment to ensure flap 104 is not unintentionally removed from body 102. In this aspect, a suitable magnet for attachment mechanism 116 may be a Neodymium Iron Boron magnet having a grade or strength of 40 megagauss-oersteds (Neo-40). Neo-40 disk magnets are commercially available from, for example, K&J Magnetics Inc. of Jamison, Pa. Although a Neo-40 magnet is described, it is further contemplated that the strength of the Neodymium Iron Boron magnet may vary within a range of from about 24 megagauss-oersteds to about 40 megagauss-oersteds. In addition, it is contemplated that other types of magnets having varying strengths may be used, including, but not limited to, a Samarium Cobalt (SmCo), Alnico, Ceramic, Ferrite, or plastic magnet.

In some embodiments, attachment mechanism 118 used to hold flap 104 closed may be a set of magnets which are the same as, or different from, those used for attachment mechanism 116. For example, in some embodiments, it is desired that attachment mechanism 118 hold flap 104 in a closed position while being capable of being released with minimal force so that the user can easily access contents being stored within body 102. In this aspect, attachment mechanism 118 may be a set of magnets having less magnetic strength than the magnets selected for attachment mechanism 116.

Although magnets are specifically described above, it is further contemplated that other types of attachment mechanisms may be used to attach flap 104 to body 102 or itself. Alternative attachment mechanisms may include, but are not limited to, snaps, buttons, hooks, toggles, hook and loop fasteners, buckles and the like. Another such alternative attachment mechanism may be a prong type attachment mechanism as will be discussed in more detail in reference to FIG. 7.

Figure 3:
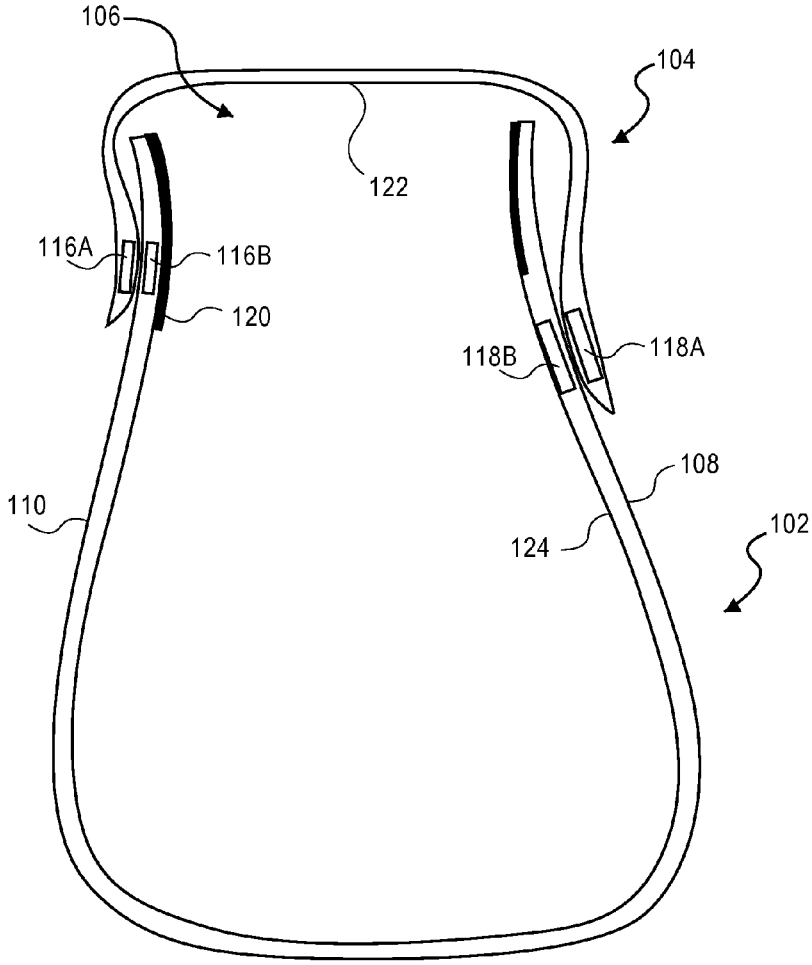
FIG. 3 shows a cross-sectional side view of the handbag system of FIG. 2.

FIG. 3 shows a cross-sectional side view of the handbag system of FIG. 2 with flap 104 attached to body 102. In this embodiment, attachment components 118A, 118B are shown embedded within flap 104 and body 102, respectively, and aligned with one another at front panel 108. Attachment components 116A, 1168 are further shown embedded within flap 104 and body 102, respectively, and aligned with one another at back panel 110 of body 102. From this view, it can be seen that, the back portion of flap 104 and the front portion of flap 104 are flush with panels of body 102 when secured to body 102. Accordingly, no unnecessary bulk is added to handbag system 100 and no visible attachment mechanism components are exposed along an outer or inner surface of handbag system 100.

Figure 4:
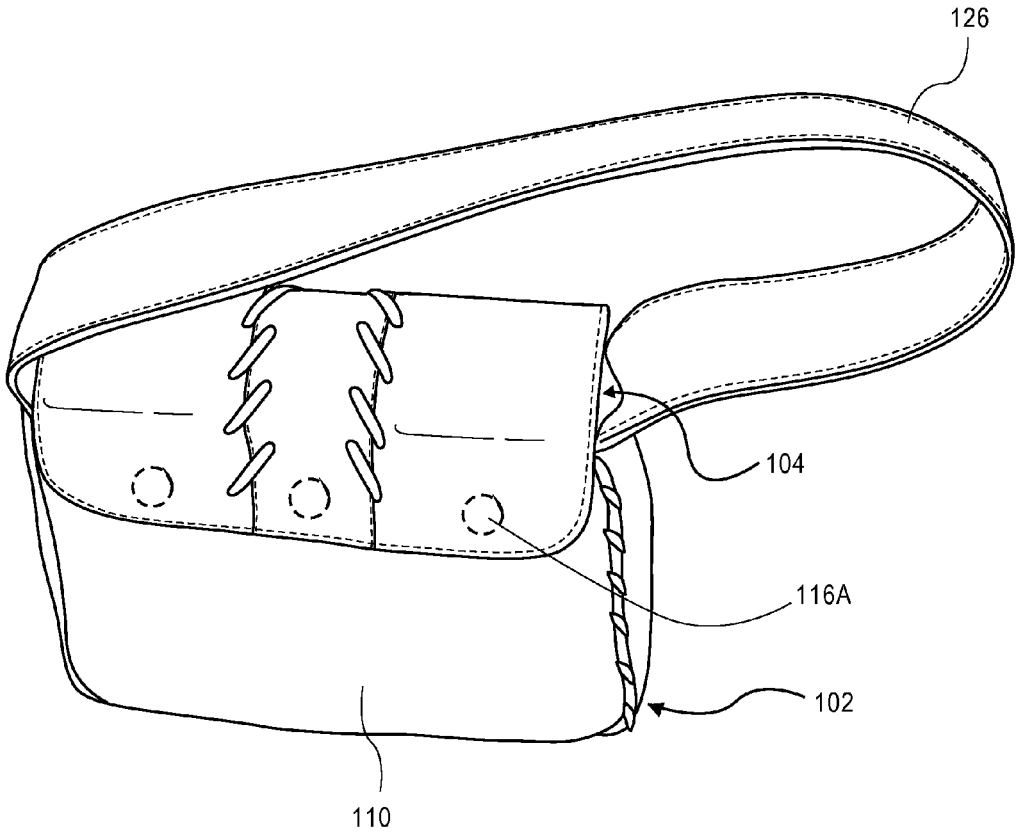
FIG. 4 shows a back perspective view of the handbag system of FIG. 2.

FIG. 4 shows a back perspective view of the handbag system of FIG. 2. In this embodiment, a back portion of flap 104 removeably secured to back panel 110 of body 102 is illustrated. From this view, it can be seen that attachment components 116A are completely hidden within flap 104 and are aligned along a straight edge of flap 104. Although flap 104 is shown extending less than half way down back panel 110, it is contemplated that the dimensions of flap 104 and body 102 may vary. Accordingly, in some embodiments, flap 104 may cover more or less of panel 110 or panel 108 than what is shown in the figures.

Figure 5:
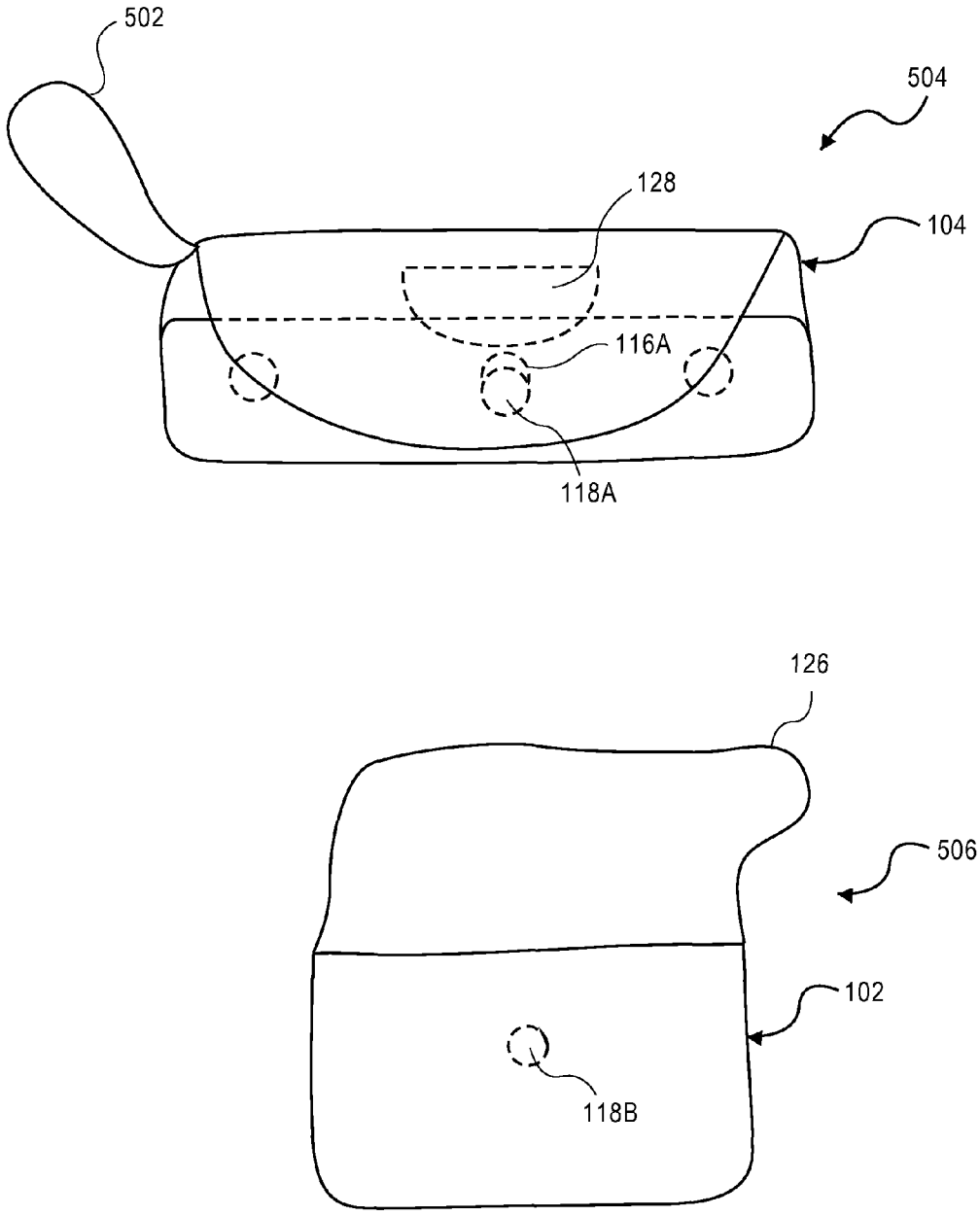
FIG. 5 shows a front view of the handbag system of FIG. 1 with the handbag body forming one handbag and the flap folded upon itself to form a separate handbag.

FIG. 5 shows a front view of the handbag system of FIG. 1 with the handbag body forming one handbag and the flap folded upon itself to form a separate handbag. In this embodiment, body 102 is shown without flap 104 attached and having strap 126 attached thereto. Body 102 forms a first handbag 506. A second, separate, handbag 504 is further formed by flap 104. Flap 104 may be dimensioned to form a handbag 504 of any size or dimension suitable for carrying items. Handbag 504 may have the same or a different size than that of handbag 506. Representatively, in some embodiments, handbag 504 may have the size and dimensions of a clutch, wallet or the like.

Handbag 504 is formed by folding a front portion of flap 104 having attachment component 118A over a back portion of flap 104 having attachment components 116A. Alternatively, the back portion of flap 104 may be folded over the front portion of flap 104. When flap 104 is folded over itself in this manner, the middle attachment component 116A is aligned with attachment component 118A. In the case where each of attachment components 116A and 118A include magnets, a side of attachment component 116A facing attachment component 118A in the above-described folded position may have an opposite polarity to that of attachment component 118A such that they are attracted to each other and hold flap 104 in the folded position.

For example, a north pole of attachment components 116A and 118A may face an inner surface of flap 104. When the bottom portion of flap 104 including attachment components 116A and the top portion of flap 104 are folded over the inner surface, a south pole of the center attachment components 116A is adjacent a north pole of attachment component 118A.

It is further contemplated that where attachment components 116A, 118A are arranged along flap 104 as described above, attachment components 116B, 1188 are arranged such that their south poles are facing an outer surface of body 102. In this aspect, flap 104 may further be secured to body 102 to form a single handbag including a flap cover. Alternatively, the south poles of attachment components 116A and 118A may face an inner surface of flap 104 and attachment components 116B and 118B may be arranged such that their north poles are facing an outer surface of body 102.

In addition to strap 126 attached to handbag 506, strap 502 may be provided to facilitate carrying of handbag 504. Strap 502 may be a wristlet type strap dimensioned to form a loop through which a user's hand can fit. Strap 502 is secured to handbag 504 at one end. In this aspect, handbag 504 may be carried around within a user's hand or around the user's wrist via strap 502. Strap 502 may be removeably secured to a portion of flap 104. Any suitable technique for removeably securing strap 502 to flap 104 may be used. Representative securing mechanisms may include, but are not limited to, a snap, clip, tie, buckle or the like. In some embodiments, strap 502 is removeably secured to handbag 504 using a ring attached to the ends of strap 502 and a clasp dimensioned to be inserted through the ring. The clap is attached to an edge of flap 104. The clasp may be secured to a portion of flap 104 beneath a fold so that the securing mechanism is hidden from view when flap 104 is folded upon itself to form handbag 504. Alternatively, a strap or handle may be attached along an outer surface of flap 104 to facilitate carrying of handbag 504 or a handbag formed when flap 104 is attached to body 102 as illustrated in FIG. 2.

Pocket 128 may further be provided to hold items of the user within handbag 504. In one embodiment, an opening of pocket 128 is formed along an inner surface of flap 104. In this aspect, the opening is covered when the ends of flap 104 are folded over each other but exposed when flap 104 is unfolded. This configuration is further illustrated in FIG. 6.

Figure 6:
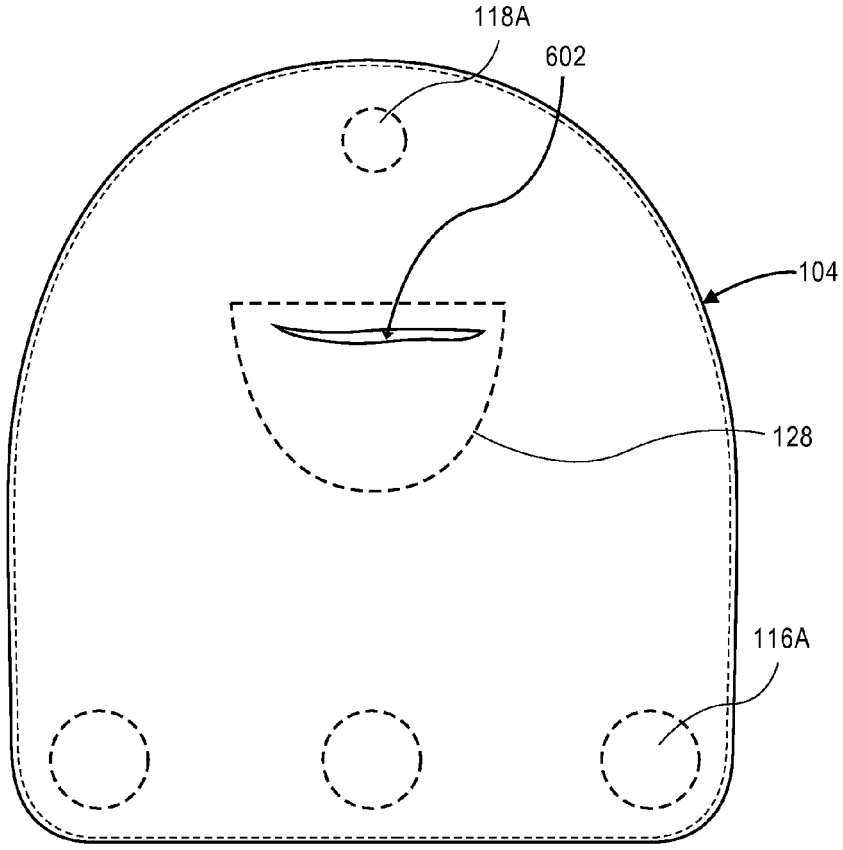
FIG. 6 shows a top view of the flap in an unfolded position.

FIG. 6 shows a top view of flap 104 in an unfolded position. It can be seen from FIG. 6 that when flap 104 is unfolded, opening 602 of pocket 128 is accessible to the user. It is contemplated that pocket 128 and opening 602 may be of any size and dimension suitable for carrying contents within handbag 504. As previously discussed, opening 602 may include a sealing mechanism, such as, a zipper, snap, button or the like, to close opening 602 of pocket 128 and prevent items stored within pocket 128 from falling out. It is further contemplated that opening 602 may be closed by a flap extending from the inner surface of flap 104 and over opening 602.

Alternatively, pocket 128 may be accessible from an outer surface of flap 104. It is further contemplated that more than one pocket may be provided to hold additional items within handbag 504.

Figure 7A:
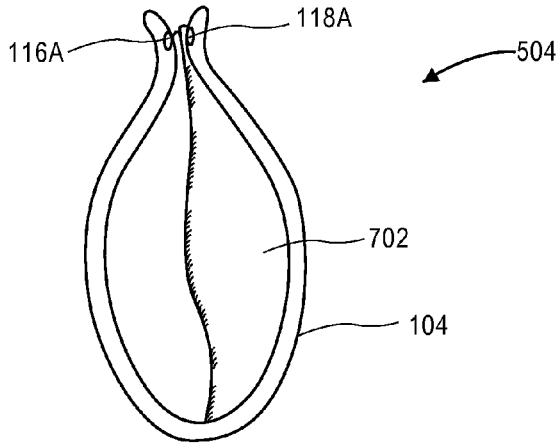
FIG. 7A shows a side view of another embodiment of a flap folded upon itself to form a separate handbag.

In an alternative embodiment, handbag 504 may be formed by folding flap 104 in half as shown in FIG. 7A: In particular, the back portion and front portions of flap 104 may be folded toward one another such that flap 104 includes a single fold along its center. The front and back portions of flap 104 may then be held together along their inner surfaces using attachment components 116A, 118A.

A side flap 702 may be provided to cover an open side of flap 104 when folded in this manner. Side flap 702 may be attached to an inner surface of flap 104. In some embodiments, two side flaps 702A, 702B may be provided to cover openings along opposite edges of folded flap 104.

Figure 7B:
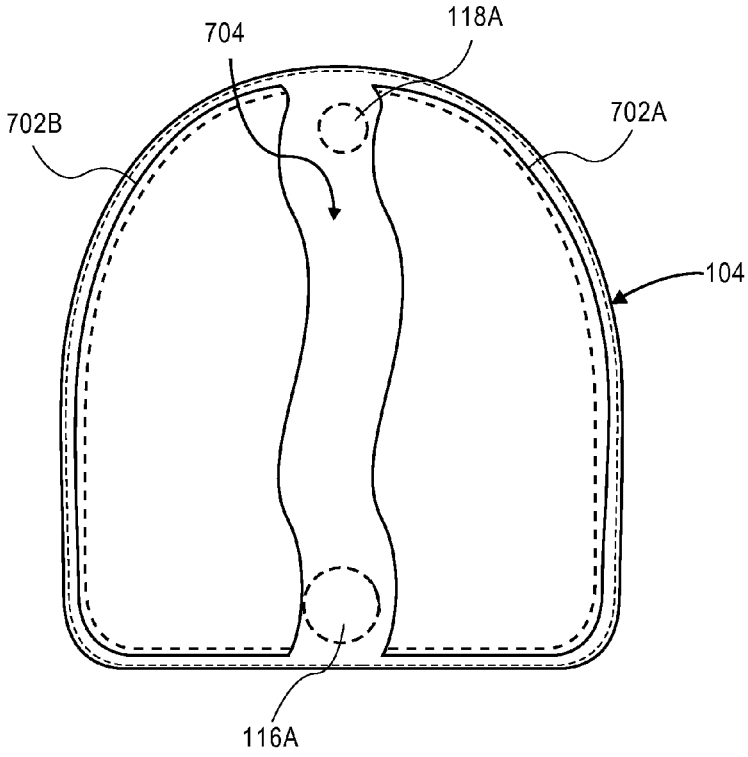
FIG. 7B shows a top view of another embodiment of the flap in an unfolded position.

Side flaps 702A, 702B are illustrated in FIG. 7B. In particular, each of side flaps 702A, 702B may be dimensioned to cover opposite halves of flap 104 when flap 104 is in an unfolded position as shown in FIG. 7B. For example, side flap 702A may cover a right half of flap 104 and side flap 702B may cover a left half of flap 104. In this aspect, side flaps 702A, 702B may have substantially the same dimensions as the half of flap 104 it covers. Edges of side flaps 702A, 702B matching edges of flap 104 may be secured to flap 104 by any suitable securing technique. Representatively, the edges may be sewn together. In still further embodiments, the edges of flaps 702A, 702B and flap 104 may be removeably attached together by, for example, a hook and loop type fastener, snaps or the like. Side flaps 702A, 702B may be made of the same or different material than that of flap 104. Representatively, side flaps 702A, 702B may be made of a woven fabric or leather material.

Gap 704 may be formed along a center of flap 104 between the free edges of side flaps 702A, 702B. In the unfolded flap 104 configuration illustrated in FIG. 7B, gap 704 is relatively narrow because the material of side flaps 702A, 702B is stretched across flap 104. When the front and back portions of flap 104 are folded together, however, the material of side flaps 702A, 702B begins to pucker causing gap 704 to widen. As illustrated in FIG. 7B, gap 704 runs between attachment components 116A, 118A. Thus, when the front and back portions of flap 104 are folded together, side flaps 702A, 702B along with flap 104 form a compartment within folded flap 104 and gap 704 provides an opening for accessing the compartment. The opening may be closed or opened via attachment components 116A, 118A as illustrated in FIG. 7A.

Figure 8:
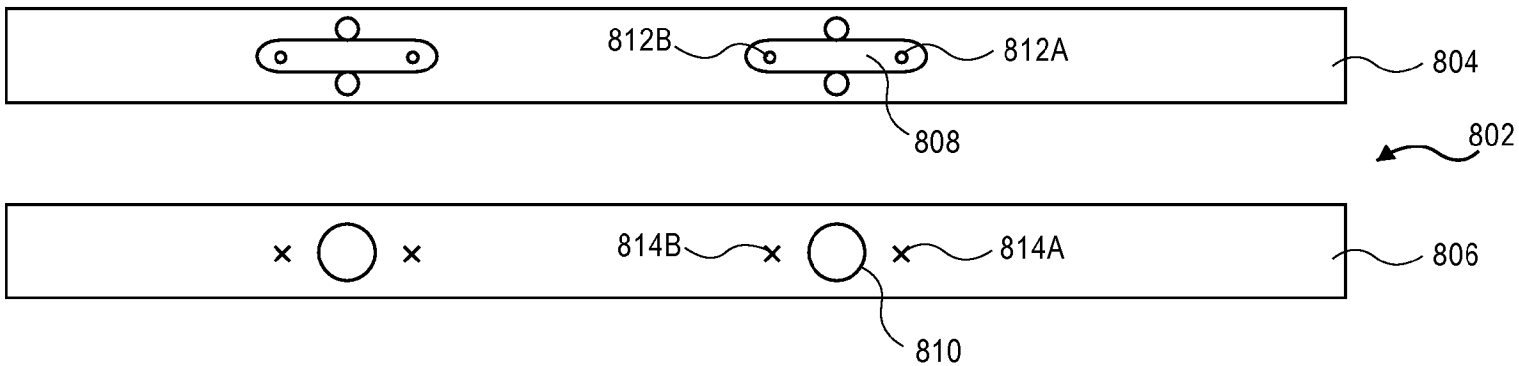
FIG. 8 shows a top view of an embodiment of an attachment mechanism for securing the flap to the handbag body.

Although the use of magnetic attachment mechanisms is described in detail herein, it is contemplated that other types of attachment mechanisms may be used. FIG. 8 shows a top view of one such alternative embodiment of an attachment mechanism for securing flap 104 to handbag body 102. In this embodiment, attachment mechanism 802 includes complimentary attachment components in the form of a prong 808 having nubs 812A, 812B at each end and aperture 810 having indents 814A, 814B on opposite sides. Indents 814A, 814B, denoted in FIG. 8 by an "x," are positioned on each side of aperture 810. Although two prongs 808 and two apertures 810 are illustrated, it is contemplated that any number of prongs 808 and apertures 810 deemed desirable may be used.

Prong 808 may be an elongated structure having nubs 812A, 812B on each end. Prong 808 may be attached to an inner or outer surface of back panel 110 of body 102. Alternatively, prong 808 may be attached to an inner or outer surface of flap 104. Prong 808 may be directly or indirectly attached to the surface at its center so that the ends having nubs 812A, 812B are free. For example, in some embodiments, prong 808 is indirectly attached by, for example, tacking it at its center to a strip 804 which is in turn attached to a surface of body 102 or flap 104. Strip 804 may be, for example, a plastic or fabric material attached to the surface of body 102 or flap 104. Strip 804 may be attached to body 102 by any suitable securing mechanism, including but not limited to, a hook and loop fastener, an adhesive or the like. Prong 808 may be made of a rigid yet resilient material, including, but not limited to, a metal, plastic or the like.

Aperture 810 may be formed through a strip 806 similar to strip 804. Strip 806 may be attached to an inner surface or outer surface of panel 110 depending upon whether strip 804 is attached to an inner or outer surface of flap 104. For example, if strip 804 is attached to an outer surface of flap 804, strip 806 may be attached to an inner surface of body 102 so that prong 808 aligns with aperture 810 when an outer surface of flap 104 is placed adjacent an inner surface of body

102. Alternatively, strip 806 may be omitted and aperture 810 may be formed through reinforcement strip 120 or lining 124 of body 102. In this embodiment, portions of strip 806 defining by aperture 810 may have reinforced edges to prevent tearing of aperture 810. In this aspect, indents 814A, 814B are formed in the material of body 102 by, for example, attaching to body 102 a piece of preformed plastic in the form of an indent or adding a component to the material of body 102, such as a glue component which retains its shape when it dries, and forming body 102 into the desired indent shape.

Figure 9:
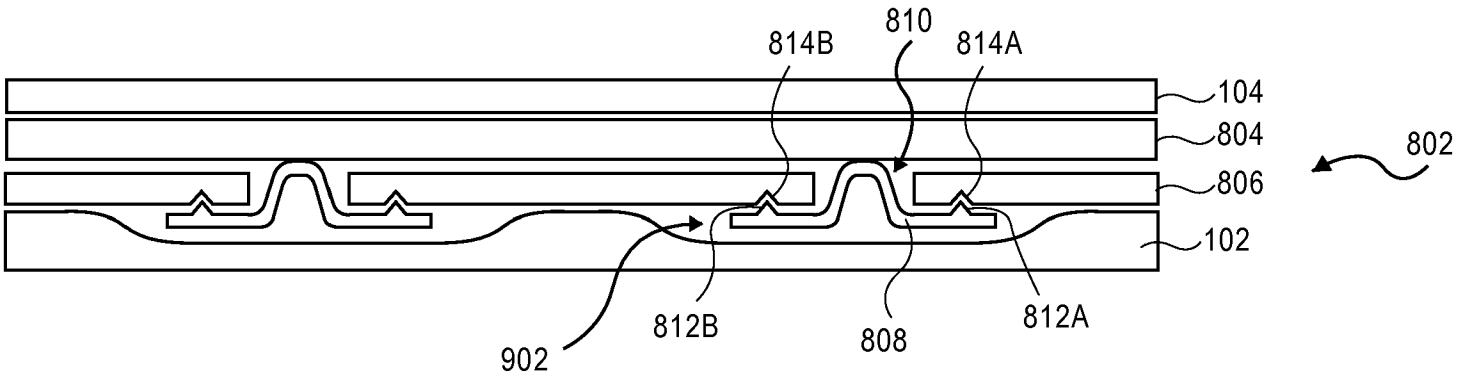
FIG. 9 shows a cross-sectional side view of the attachment mechanism of FIG. 8.

Aperture 810 may be dimensioned to receive prong 808 as illustrated in FIG. 9. In this aspect, strip 804 including prong 808 is attached to a surface of flap 104 and strip 806 including aperture 810 and indents 814A, 814B is attached to a surface of body 102. Prong 808 may be inserted through aperture 810 by bending the ends of prong 808 toward one another and then inserting the ends through aperture 810. As illustrated in FIG. 9, a small cavity 902 is formed between strip 806 and body 102 to accommodate the free ends of prong 808. In this aspect, once the ends of prong 808 are through aperture 810, they are flattened back out with a raised side of nubs 812A, 812B facing strip 806. The portions of strip 806 above nubs 812A, 812B and adjacent aperture 810 include indents 814A, 814B to receive nubs 812A, 812B. In this aspect, once prong 808 is positioned through aperture 810 as described, the user may press the indented portions of strip 806 over numbs 812A, 812B to snap them together. Nubs 812A,812B and indents 814A, 814B may be released from one another by, for example, placing a user's thumb over a portion of flap 104 overlying a center of prong 808 and a first and second finger on opposite sides of prong 808. The user may then press the thumb and first and second fingers together. This motion pulls strip 806 and in turn indents 814A, 814B away from the ends of prong 808 having nubs 812A, 812B and releases them.

Although prong 808 is described above as being attached to flap 104 and aperture 810 is formed along body 102, it is further contemplated that prong 808 may be attached to body 102 and aperture 810 formed along flap 104. In either case, due to the positioning of each attachment component on body 102 and flap 104 and their substantially planar dimensions, the attachment components are substantially hidden during use and flap 104 may be removeably secured to body 102 without adding significant bulk to the handbag at the point of attachment.

In addition, when flap 104 and body 102 are used separately, attachment components 808, 810 of attachment mechanism 802 may be hidden along an inner surface of body 102 or beneath the overlapping ends of flap 104 in the folded position. In this aspect, in addition to an attachment component (e.g., a prong or aperture) along a back portion of flap 104, an attachment component may be positioned along a front portion of flap 104 which is complementary to that along the back portion. Accordingly, when the back portion and front portion of flap 104 are folded over one another to form a separate handbag as previously described, they may be secured to one another.

Figure 10:
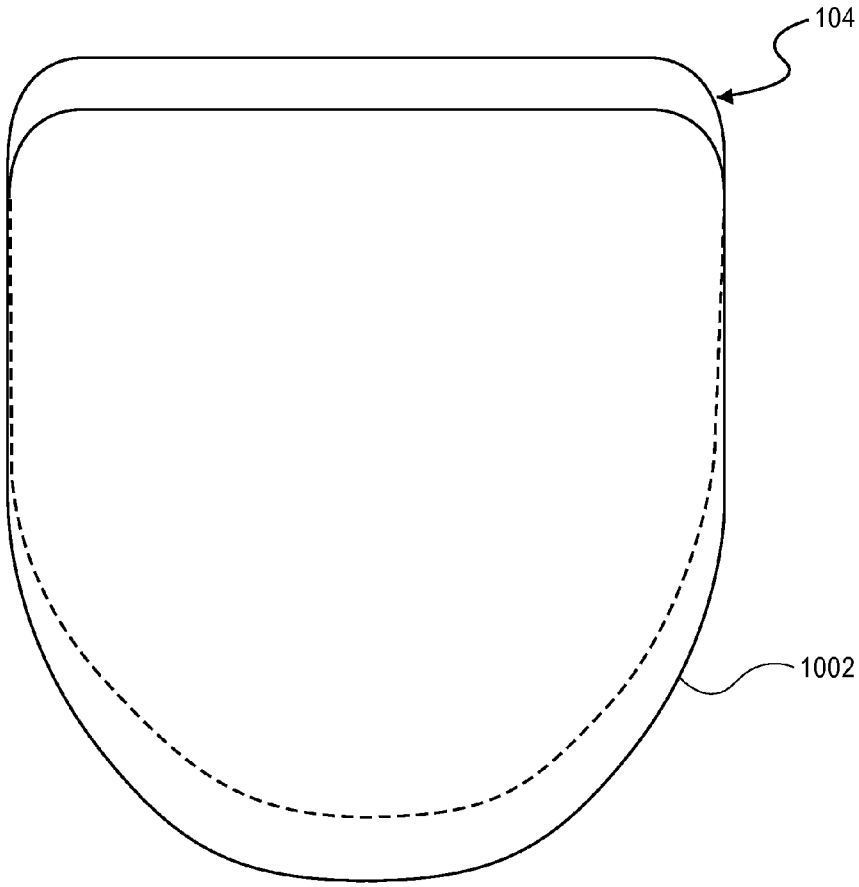
FIG. 10 shows a top view of a flap cover partially covering the flap.

FIG. 10 shows a top, cross-sectional view of a flap cover partially covering the flap. In this embodiment, a removable cover 1002 having slightly larger dimensions than flap 104 but a substantially similar shape is provided to overlay flap 104. Cover 1002 may be formed by two separate panels or a single sheet of material folded over itself. The edges of the material may be sewn together to form a pocket dimensioned to envelope flap 104. One edge of the material, however, remains open for removal and insertion of flap 104 within cover 1002. The open edge may remain open during use of flap 104, or include a sealing mechanism to close the opening. Suitable sealing mechanisms, may include, but are not limited to, a zipper, snap, button or the like.

Cover 1002 may be of the same or different material as that of flap 104. In some embodiments, a plurality of covers 1002 may be provided having a variety of colors, designs and/or materials to change the appearance of flap 104. In this aspect, a user may select a cover 1002 which matches their outfit and merely cover flap 104 with the desired cover 1002 instead of interchanging flap 104 with another.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

The invention claimed is:

1. A method comprising:

removeably coupling an interchangeable flap to a handbag body to cover an opening of the handbag body in a first position and removeablely coupling the interchangeable flap to a portion of itself in a second position to form a separate handbag using an attachment mechanism, the attachment mechanism comprising a first component completely concealed between an inner wall and an outer wall forming the interchangeable flap and a second component completely concealed within the handbag body, and wherein the interchangeable flap comprises a first side flap and a second side flap attached around an edge of the interchangeable flap and a gap formed between the first side flap and the second side flap such that when the interchangeable flap is in the first position, the first flap and the second flap cover a surface of the inner wall and in the second position, the first flap and the second flap form side walls of the separate handbag.

2. The method of claim 1 wherein the attachment mechanism aligns itself for attachment in the absence of an externally applied force.

3. The method of claim 1 wherein the attachment mechanism comprises a set of Neodymium Iron Boron 40 (NEO-40) magnets.

4. An apparatus comprising:

a flap comprising dimensions to cover an opening of a handbag body in a first position and form a separate handbag in a second position, the flap comprising an attachment mechanism suitable for attaching the flap to the handbag body in the first position and attaching the flap to itself in the second position, the attachment mechanism comprising a first magnet and a second magnet completely concealed between an inner wall and an outer wall forming the flap, and wherein the interchangeable flap comprises a first side flap and a second side flap attached around an edge of the interchangeable flap and a gap formed between the first side flap and the second side flap such that when the interchangeable flap is in the first position, the first flap and the second flap cover a surface of the inner wall and in the second position, the first flap and the second flap form side walls of the separate handbag.

5. The apparatus of claim 4 wherein in the second position, the inner wall and the outer wall of the flap contact one another and are held together using the attachment mechanism.

6. An apparatus comprising:

a handbag body, the handbag body comprising a front panel and a back panel;

an interchangeable flap removeably attached to the front panel and the back panel of the handbag body, the interchangeable flap comprises a first side flap and a second side flap attached to edges of an inner wall of the interchangeable flap;

a first attachment mechanism comprising a first magnet completely concealed between the inner wall and an outer wall forming the interchangeable flap, the inner wall faces the handbag body when the interchangeable flap is attached to the handbag body and a second magnet completely concealed within the front panel of the handbag body; and a second attachment mechanism comprising a first magnet completely concealed between the inner wall and the outer wall forming the interchangeable flap and a second magnet completely concealed within the back panel of the handbag body;

wherein the first magnet of the first attachment mechanism and the first magnet of the second attachment mechanism are positioned within the interchangeable flap such that a magnet pole of each of the first magnets facing the inner wall is the same and when the interchangeable flap is removed from the handbag body and folded onto itself, the inner wall overlaps the outer wall such that opposite poles of the first magnet of the first attachment mechanism and the first magnet of the second attachment mechanism are facing each other and attracted together to hold the interchangeable flap in a closed position, and wherein the first side flap and the second side flap form opposing side walls of the interchangeable flap when the interchangeable flap is folded onto itself.

* * * * *